US006324741B1

(12) United States Patent
Brown

(10) Patent No.: US 6,324,741 B1
(45) Date of Patent: Dec. 4, 2001

(54) METHOD AND APPARATUS FOR REMOVING A FASTENER

(75) Inventor: Michael E. Brown, Davison, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/547,258

(22) Filed: Apr. 11, 2000

(51) Int. Cl.[7] ..... B25B 27/00

(52) U.S. Cl. ..... 29/270; 81/302; 81/426.5; 29/268

(58) Field of Search ..... 254/22; 81/426.5, 81/429.5, 418, 44; 29/268, 270, 278, 239

(56) References Cited

U.S. PATENT DOCUMENTS

| | | | |
|---|---|---|---|
| 4,658,489 | 3/1987 | Johnston | 81/302 |
| 4,787,236 | 11/1988 | West | 81/362 |
| 5,546,625 | 8/1996 | Mealey | 29/270 |
| 5,611,519 | 3/1997 | Garcia | 81/426.5 |
| 6,023,833 | 2/2000 | Jacobmeier | 81/420 |

*Primary Examiner*—Joseph J. Hail, III
*Assistant Examiner*—Daniel Shanley
(74) *Attorney, Agent, or Firm*—Edwin W. Bacon, Jr.

(57) ABSTRACT

An apparatus for removing a fastener includes a main body portion. The fastener secures a first panel and a second panel and includes a retaining portion extending substantially through an aperture in the second panel. The retaining portion has a pair of resilient legs. Each resilient leg has a free end. The main body portion of the apparatus defines a slot. The slot has a open end and a closed end. The slot preferably tapers from the open end to the closed end. The slot is adapted to compress the free ends of the resilient legs together in response to translation of the fastener from the open end toward the closed end.

10 Claims, 2 Drawing Sheets

METHOD AND APPARATUS FOR REMOVING A FASTENER

BACKGROUND OF THE INVENTION

1. Field of the Invention

The present invention generally pertains to fasteners. More particular, the present invention pertains to a method and an apparatus for removing fasteners.

2. Discussion

Various types of fasteners are used for securing first and second members such as panels. One known type of fastener A is illustrated in the prior art view of FIG. 1. As shown, the fastener A is fixedly attached to a first panel B and resiliently received within an aperture C defined by a second panel D. In one exemplary use, the first panel is a body side molding B for a motor vehicle and the second panel is a sheet metal panel D of the motor vehicle.

In a conventional form, the fastener A includes a main body portion E and a retaining portion F. The main body portion E is generally T-shaped and includes an upper segment G secured to the first panel B by heat staking or through any other technique well known in the art. A stem H of the main body portion E extends through an aperture I in the first panel B and abuts the second panel D.

The retaining portion E downwardly extends through the aperture C in the second panel D and is generally W-shaped, including a pair of outer legs J and a center leg K. The center leg K downwardly extends from the main body portion E. The outer legs J each upwardly extend from a lower end of the center leg K. The upper ends of the outer legs J extend through the aperture C and are normally biased away from the center leg K. During insertion of the retaining portion F through the aperture C, each of the outer legs J is formed to include a flange or step L which abuts a lower surface of the second panel D and normally prevents withdrawal of the retaining portion F from the aperture C.

Fasteners of the type described above with reference to FIG. 1 have proven to be satisfactory for various applications. However, these fasteners are often very difficult to remove. Thus, a need remains in the art for a method and apparatus which can more easily remove fasteners of this type.

SUMMARY OF THE INVENTION

It is a general object of the present invention to provide a method and apparatus which can more easily remove fasteners of the type discussed above.

It is a related object of the present invention to provide a method and apparatus for quickly and easily removing a fastener which normally resiliently functions to secure first and second panels.

In one form, the present invention provides an apparatus for removing a fastener securing a first panel and a second panel. The fastener includes a retaining portion extending substantially through an aperture in the second panel. The retaining portion has a pair of resilient legs. Each resilient leg has a free end. The apparatus includes a main body portion defining a slot. The slot has an open end and a closed end. The slot preferably tapers from the open end to the closed end. The slot is adapted to compress the free ends of the resilient legs together in response to translation of the fastener from the open end toward the closed end.

In another form, the present invention provides a method for removing a fastener securing a first panel and a second panel. The fastener includes a retaining portion extending substantially through an aperture in the second panel. The retaining portion has a pair of resilient legs. Each resilient leg includes a free end. The method generally includes the steps of:

providing a tool having a tapered slot;

inserting the tool between the first and second panels;

receiving the fastener within the tapered slot;

compressing the free ends of the fastener together; and extracting the retaining portion from the aperture.

Additional benefits and advantages of the present invention will become apparent to those skilled in the art to which this invention relates from a reading of the subsequent description of the preferred embodiment and the appended claims, taken in conjunction with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
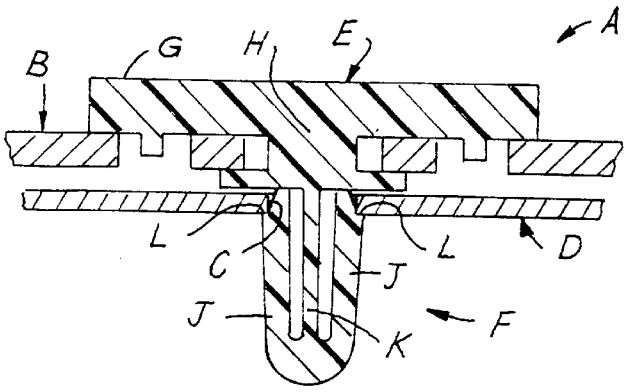
(PRIOR ART) FIG. 1
FIG. 1 is a prior art view illustrating a fastener securing a molding to a sheet metal panel of a motor vehicle.
Figure 2:
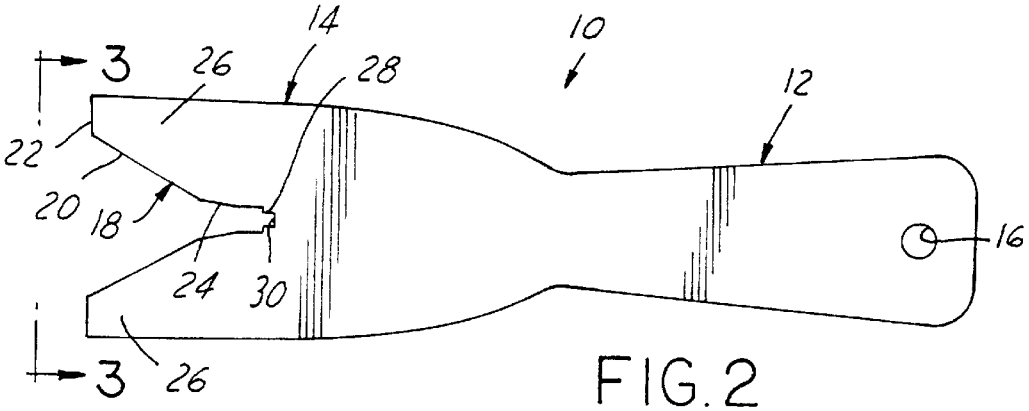
FIG. 2 is a top view of a tool constructed in accordance with the teachings of a preferred embodiment of the present invention.
Figure 3:
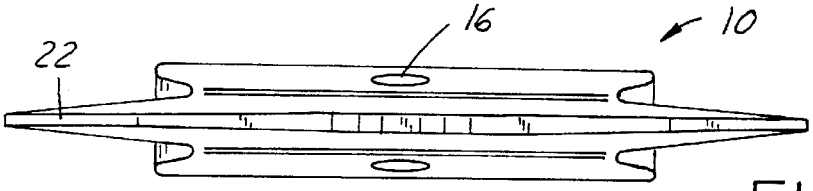
FIG. 3 is an end view of the tool of FIG. 2 taken in the direction of arrows 3 in FIG. 2.
Figure 4:
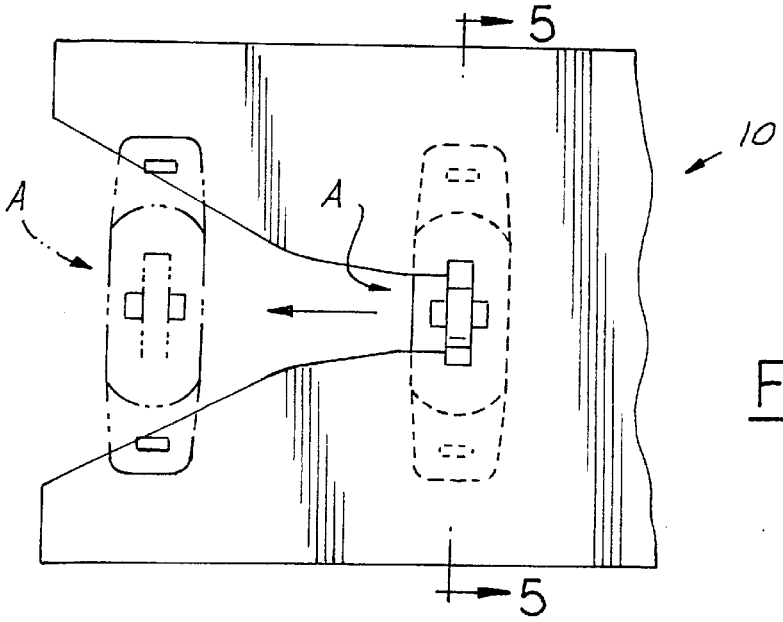
FIG. 4 is a top view of the tool of the present invention similar to FIG. 2 illustrated fully engaged with a fastener (shown in solid lines) and also illustrating a fastener prior to full engagement (shown in phantom lines).
Figure 5:
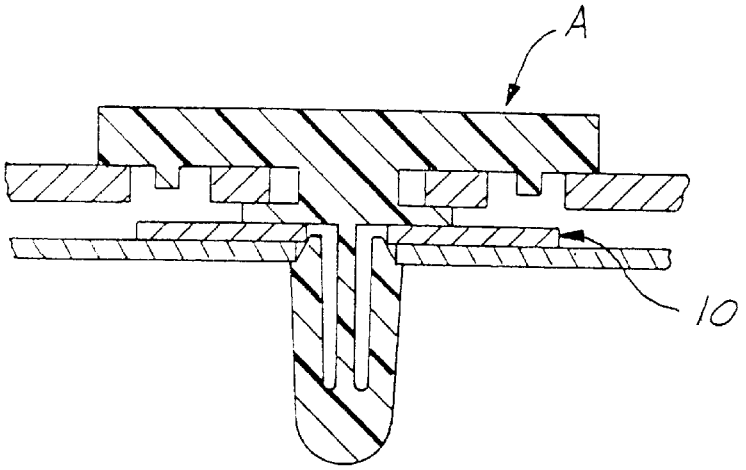
FIG. 5 is a cross-sectional view taken along the line 5—5 of FIG. 4.

With reference to FIGS. 2–5 of the drawings, an apparatus for removing a fastener constructed in accordance with the teachings of the preferred embodiment of the present invention is illustrated and generally identified with reference numeral 10. Throughout the drawings, the apparatus 10 of the present invention is shown specifically adapted for use with and operatively associated with a particular fastener A. The particular fastener A shown is of the type described above It will be clearly understood that the particular fastener A is but one specific type of fastener which can be removed within apparatus 10 constructed in accordance with the teachings of the present invention.

In the preferred embodiment, the apparatus 10 is unitarily constructed of a rigid plastic or other suitable material. The apparatus 10 is illustrated to generally include a handle portion 12 and a working portion 14. In the exemplary embodiment, the handle portion 12 is formed to include an aperture 16 for hanging the apparatus 10 on a hook or aperture (not shown).

The working portion 14 of the apparatus 10 defines an elongated slot 18 for receiving the fastener A. In the exemplary embodiment illustrated, the slot 18 includes a first portion 20 which is open adjacent an end 22 of the working portion 14. The elongated slot 18 further includes a second portion 24. The first portion 20 has a first taper end and the second portion has a second taper end. In the preferred embodiment, the first taper of the first portion 20 is significantly greater than the taper of the second portion. The edges of the working portion which define the first portion 20 of the elongated slot 18 function as lead-in surfaces for directly the fastener into the elongated slot. In this manner, the fastener A can be properly engaged with the elongated slot 18 without the operator necessarily visually perceiving the fastener A.

The second portion of the elongated slot is considerably more narrow than the first portion 20. The second portion 24 functions to compress the free ends J of the fastener A together to permit withdrawal of the fastener A.

In the preferred embodiment, the working portion 14 of the apparatus 10 preferably effectively includes a pair of arms 26. The arms 26 taper in a direction parallel to the elongated slot 18 and toward the ends 22 of the apparatus 10. The elongated slot 18 further includes a closed end 28 which defines a stop surface for abutting the pair of resilient legs J of the fastener A. The closed ends 28 of the elongated slot 18 preferably defines a narrow portion 30 which receives the center leg K of the fastener A and thereby prevent rotation of the fastener A within the elongated slot 18.

In the preferred embodiment, the working portion 14 tapers to facilitate insertion of the working portion 14 between the stem H of the fastener A and the second panel D. As shown most particularly in the end view of FIG. 3, the working portion tapers from adjacent the intersection of the working portion and the handle portion to the ends 22. Thus, the narrowest width of the working portion 22 is found at the ends 22.

Figure 6:
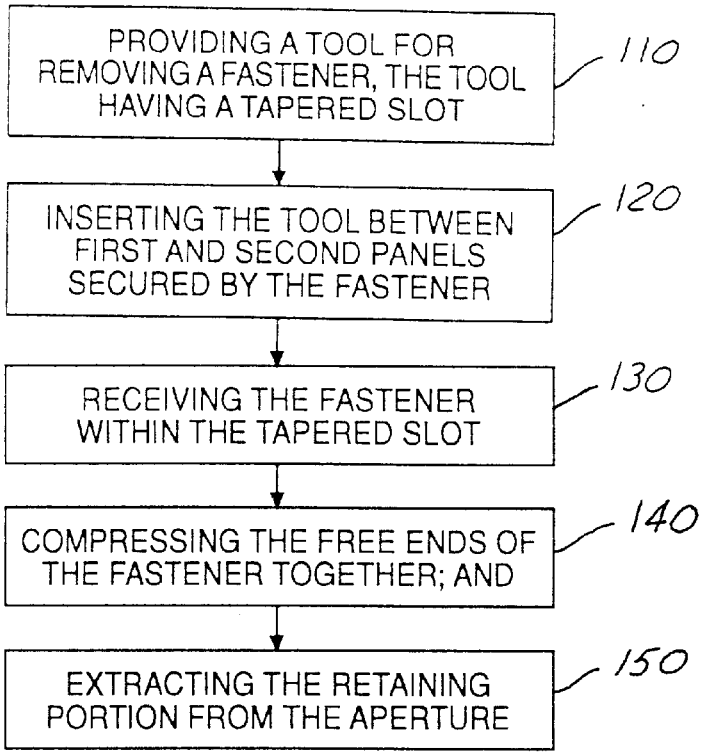
FIG. 6 is a schematic diagram illustrating the general steps of a preferred method of the present invention.

With continued reference to FIGS. 1–6 and additional reference to FIG. 6, a preferred method of the present invention will be described. In a first general step 110, the method of the present invention includes providing a tool for removing a fastener. The tool has a tapered slot 18.

In a second general step 120, the method of the present invention includes inserting the tool 10 between first and second panels B and D secured by the fastener A.

In a third general step 130, the method of the present invention includes receiving the fastener A within the tapered slot 18.

In a fourth general step 140, the method of the present invention includes compressing the free ends of the fastener A together.

In a fifth general step 150, the method of the present invention includes extracting the retaining portion F of the fastener A from an aperture C in the second panel D.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. An apparatus for removing a fastener for securing a first panel and a second panel, the fastener including a retaining portion for extending substantially through an aperture in the second panel, the retaining portion having a pair of resilient legs each having an free end, the apparatus comprising:

a main body portion defining a slot; and the slot having an open end and a closed end, the slot adapted to compress the free ends of the resilient legs together in response to translation of the fastener from the open end toward the closed end.

2. The apparatus for removing a fastener of claim 1, wherein the slot tapers from the open end to the closed end.

3. The apparatus for removing a fastener of claim 1, further comprising a pair of legs arms generally parallel to the slot.

4. The apparatus for removing a fastener of claim 3, wherein the pair of legs have a thickness which tapers in a direction parallel to the slot and toward the open end.

5. The apparatus for removing a fastener of claim 1, wherein the closed end of the slot includes at least one stop surface for abutting the pair of resilient legs and a narrowed portion for receiving a portion of the fastener to prevent rotation of the fastener within the slot.

6. An apparatus for removing a fastener in combination with the fastener, the fastener for securing a first panel and a second panel and including a retaining portion for extending substantially through an aperture in the second panel, the retaining portion having a pair of resilient legs each having a free end, the apparatus comprising:

a main body portion defining a slot; and the slot having an open end and a closed end, the slot adapted to compress the free ends of the resilient legs together in response to translation of the fastener from the open end toward the closed end.

7. The apparatus for removing a fastener of claim 6, wherein the slot tapers from the open end to the closed end.

8. The apparatus for removing a fastener of claim 6, further comprising a pair of arms extending generally parallel to the slot.

9. The apparatus for removing a fastener of claim 8, wherein the pair of legs have a thickness which tapers in a direction parallel to the slot and toward the open end.

10. The apparatus for removing a fastener of claim 6,wherein the closed end of the slot includes at least one stop surface for abutting the pair of legs and a narrowed portion for receiving a portion of the fastener to prevent rotation of the fastener within the slot.

* * * * *